US011610727B2

(12) United States Patent
Kawashima

(10) Patent No.: US 11,610,727 B2
(45) Date of Patent: Mar. 21, 2023

(54) COIL COMPONENT AND COIL DEVICE

(71) Applicant: SUMIDA CORPORATION, Tokyo (JP)

(72) Inventor: Hiroshi Kawashima, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 985 days.

(21) Appl. No.: 16/256,557

(22) Filed: Jan. 24, 2019

(65) Prior Publication Data

US 2019/0272942 A1 Sep. 5, 2019

(30) Foreign Application Priority Data

Mar. 5, 2018 (JP) ..... JP2018-039132

(51) Int. Cl.

| | |
|---|---|
| ***H01F 27/28*** | (2006.01) |
| ***H01F 27/26*** | (2006.01) |
| ***H01F 41/071*** | (2016.01) |
| ***H01F 41/061*** | (2016.01) |
| ***H01F 27/30*** | (2006.01) |
| ***H01F 37/00*** | (2006.01) |

(52) U.S. Cl.

CPC ..... *H01F 27/2828* (2013.01); *H01F 27/263* (2013.01); *H01F 27/2823* (2013.01); *H01F 27/306* (2013.01); *H01F 37/00* (2013.01); *H01F 37/005* (2013.01); *H01F 41/061* (2016.01); *H01F 41/071* (2016.01)

(58) Field of Classification Search

USPC ..... 336/192, 90, 65, 212, 221, 178

See application file for complete search history.

(56) References Cited

U.S. PATENT DOCUMENTS

| | | | | |
|---|---|---|---|---|
| 2014/0152414 | A1* | 6/2014 | Kawashima | H01F 41/071 336/192 |
| 2014/0152415 | A1* | 6/2014 | Kawashima | H01F 41/071 336/192 |
| 2017/0194087 | A1* | 7/2017 | Yamamoto | H01F 27/255 |
| 2018/0358172 | A1* | 12/2018 | Yamamoto | H01F 37/00 |

FOREIGN PATENT DOCUMENTS

| | | | |
|---|---|---|---|
| JP | H10172852 | A | 6/1998 |
| JP | 3398855 | B2 | 4/2003 |
| JP | 2009-129961 | A | 6/2009 |
| JP | 2009124833 | A * | 6/2009 |
| JP | 2014-112611 | A | 6/2014 |
| JP | 5949137 | B2 | 7/2016 |

OTHER PUBLICATIONS

Jan. 6, 2022 Office Action issued in Japanese Application No. 2018-039132.

* cited by examiner

*Primary Examiner* — Shawki S Ismail
*Assistant Examiner* — Kazi S Hossain
(74) *Attorney, Agent, or Firm* — Oliff PLC

(57) ABSTRACT

A coil component 100 includes a first coil element 111 and a second coil element 112 each formed in an angular-tubular shape and disposed in parallel by winding and laminating a single flat wire 101 in one direction with edgewise-winding between one end portion 101A and another end portion 101B and bending the wound and laminated coil into two, and includes an interconnection part 113 for connecting the both elements. The interconnection part 113 includes a coil element winding end portion side raised part 123A, a coil element winding start portion side raised part 123B, and an intermediate part 123C extended between the two raised parts 123A and 123B.

7 Claims, 17 Drawing Sheets

EMBODIMENT3

EMBODIMENT1

EMBODIMENT1

EMBODIMENT1

EMBODIMENT1

EMBODIMENT1

EMBODIMENT1

EMBODIMENT2

EMBODIMENT2

EMBODIMENT3

EMBODIMENT3

MODIFICATION

COIL COMPONENT AND COIL DEVICE

RELATED APPLICATION

This invention claims the benefit of Japanese Patent Application No. 2018-039132 filed on Mar. 5, 2018, which is incorporated herein by reference.

BACKGROUND OF THE INVENTION

Field of the Invention

The present invention relates to a coil component and a coil device used for inverter circuits and various motors and the like used for automobiles and the like and, more specifically, to a coil component configured with two angular-tubular shaped laminated coils formed with a single flat wire and provided adjacent to each other and to a coil device using the same.

Description of the Prior Art

A coil component such as a reactor, for example, can generate an inductance with a structure where a winding coil is wound around a magnetic core.

There are various types known as the reactors depending on the purpose of use from a type of a large capacitance used for a power transmission system to a component of a communication apparatus.

Incidentally, as the reactors or the like used for booster circuits used on board, known is a type formed by placing two laminated coil components in parallel so that a high inductance value can be acquired when a high electric current is flown.

As a conventional example of such reactors, known is a type acquired by forming two coil elements disposed in parallel through edgewise-winding a single flat wire (see Japanese Patent No. 3398855, for example).

In Japanese Patent No. 3398855, a first coil element and a second coil element are formed in parallel acquired by winding the flat wire with edgewise-winding while shaping the flat wire into a circular shape. The flat wire drawn between the two coil elements is drawn from one element to the other by being twisted by 180 degrees between the two coil elements.

Further, in the technique disclosed in Japanese Patent No. 5949137, at a position opposing to a magnetic core forming a closed loop, formed in parallel are a first coil element 28*a* and a second coil element 28*b* which are formed by edgewise-winding a flat wire wound in a rectangular shape as a whole with four corners being bent portions. Further, at an interconnection part 29*c* of the two coil elements 28*a* and 28*b*, the flat wire is drawn from a winding end portion of one of the coil elements to a winding start portion of the other coil element while being slightly floated up to a front side of an end-face.

Further, in the conventional case depicted in Japanese Patent No. 5949137, as shown in FIG. 17, out of a conductor constituting a coil 28, a base end of a conductor edge 29*a* of the coil element 28*a*, a base end of a conductor edge 29*b* of the coil element 28*b*, and both end portions (coil winding end portion and coil winding start portion) of the interconnection part 29*c* connecting each of the coil elements 28*a* and 28*b* are pinched by a slit of a coil support part 60 provided to a coil bobbin 22. Thereby, the coil 28 is held in a state of being positioned with respect to a reactor core 14 and the coil bobbin 22.

SUMMARY OF THE INVENTION

In the technique depicted in Japanese Patent No. 3398855 described above, the twisted flat wire comes in a gap between the two coil elements so that a distance between the two coil elements is expanded. Therefore, it is difficult to downsize the coil device.

Expansion of the gap between the two coil elements even by several millimeters, for example, results in a great deterioration in the magnetic property, so that it is desired to employ a structure causing no such twisting of the flat wire.

Meanwhile, following shortcomings are pointed out with the technique depicted in Japanese Patent No. 5949137 described above.

That is, in the conventional technique depicted in Japanese Patent No. 5949137, the conductor configuring the coil 28 is pinched, positioned and fixed by a slit of a coil support part 60. Therefore, such structure with the coil support part 60 results in increase in the number of manufacturing steps and increase in manufacturing cost.

In view of such circumstances, it is an object of the present invention to provide a coil component and a coil device capable of shortening the distance of the gap between coils elements so that it is unnecessary to position and fix a flat wire configuring the coil by using another member when drawing out the flat wire.

In order to overcome such shortcomings, the coil component and the coil device according to the present invention includes following features.

That is, the coil component according to a first aspect of the present invention includes: a first coil element and a second coil element formed by dividing and folding, at a prescribed position, into two a winding coil formed by laminating a single flat wire into a rectangular shape with edgewise-winding, the first coil element and the second coil element being disposed with opposing side-faces placed along in parallel to each other; and an interconnection part to connect those two coil elements. Provided that, in end-faces where the first coil element and the second coil element are connected, a side of the first coil element and a side of the second coil element adjacent to each other among each of sides of a rectangular part forming the end-faces of each of the coil elements and sides in parallel to those sides are referred to as first sides, the interconnection part connects a coil element winding end portion located in vicinity of an edge of one of the first sides of one of the two coil elements or on an extension of the first side with a coil element winding start portion located in vicinity of an edge of one of the first sides of the other one of the two coil elements or on an extension of the first side. Further, the interconnection part includes, in the coil element winding start portion and the coil element winding end portion, a coil element winding start portion side raised part and a coil element winding end portion side raised part configured by twisting and raising the flat wire at a right angle in a same direction with respect to each other, and includes an intermediate part extended between those two raised parts.

Further, the coil component according to a second aspect of the present invention includes: a first coil element and a second coil element formed by dividing and folding, at a prescribed position, into two a winding coil formed by laminating a single flat wire into a rectangular shape with edgewise-winding, the first coil element and the second coil element being disposed with opposing side-faces placed along in parallel to each other; and an interconnection part to connect those two coil elements. Provided that, in end-faces where the first coil element and the second coil element are connected, a side of the first coil element and a side of the second coil element adjacent to each other among each of sides of a rectangular part forming the end-faces of each of the coil elements and sides in parallel to those sides are referred to as first sides, the interconnection part connects a coil element winding end portion located in vicinity of an edge of one of the first sides of one of the two coil elements or on an extension of the first side with a coil element winding start portion located in vicinity of an edge of one of the first sides of the other one of the two coil elements or on an extension of the first side. Further, the interconnection part includes, in the coil element winding start portion and the coil element winding end portion, a coil element winding start portion side bent part and a coil element winding end portion side bent part configured by bending the flat wire at a right angle in directions approaching each other, and includes an intermediate part extended between those two bent parts.

Further, when the first sides located on inner side of the first coil element and the second coil element are referred to as inner first sides and the first sides located on outer side are referred to as outer first sides, the interconnection part connects either one of the coil element winding start portion and the coil element winding end portion located in vicinity of an edge of one of the inner first sides of one of the two coil elements or on an extension of the inner first side with another one out of the coil element winding start portion and the coil element winding end portion located in vicinity of an edge of one of the outer first sides of the other one out of the two coil elements or on an extension of the outer first side.

It is preferable that among the side-faces of the first coil element and the second coil element, an end-face position on a prescribed side of the intermediate part is located in outer side of a radial direction of the first coil element and the second coil element than side-face positions of the side-faces on the prescribed side most adjacent to a position where the intermediate part is provided.

Further, it is preferable that the intermediate part is formed in a curved shape.

Further, it is preferable that the intermediate part is formed in a planar shape.

Preferably, a coil device includes the coil component according to the present invention and a magnetic core forming a closed magnetic path by inserting each leg part into a hollow part of the coil component.

Note here that "edgewise-winding" mentioned above refers to a winding method with which the flat wire is wound vertically and laminated in a tabular form having a short side that is one of side edges of the flat wire as an inner diameter face.

In the coil component according to the first aspect of the present invention, the interconnection part for connecting the two coil elements is configured to connect the coil element winding end portion located in the vicinity of the edge of one of the first sides of one of the two coil elements or on the extension of the first side with the coil element winding start portion located in the vicinity of the edge of one of the first sides of the other one of the two coil elements or on the extension of the first side.

Further, the interconnection part includes, in the coil element winding start portion and the coil element winding end portion, the coil element winding start portion side raised part and the coil element winding end portion side raised part configured by twisting and raising the flat wire at a right angle in the same direction with respect to each other, and includes the intermediate part extended between those two raised parts.

Thereby, the interconnection part is formed to be projected out toward the end-face side since both raised parts are provided by twisting the flat wire at right angle in the same direction with respect to each other from one of the end-faces side of the both coil elements. Therefore, it is possible to prevent the twisted flat wire from being interposed in the gap between the both coil elements so that expansion of the distance between the two coil elements can be avoided. As a result, the core can be downsized, and deterioration of the magnetic property can be avoided.

This is the same also with the coil component according to the second aspect of the present invention.

Further, each of the raised parts is provided not on a second side orthogonal to the first side but provided in the vicinity of the edge of the first side or on the extension of the first side and twisting at a right angle in the same direction with respect to each other is applied to the both raised parts as well. This makes it possible to provide a state with no twisting generated in the intermediate part between the both raised parts. Also, twisting provides the both raised parts with a function of self-standing and remaining at the positions. As a result, unlike the conventional technique shown in FIG. 17, it becomes unnecessary to provide the coil support part 60, so that increase in the number of manufacturing steps and increase in the manufacturing cost can be suppressed.

This is also the same with a coil element winding start portion side bent part and a coil element winding end portion side bent part configured to be bent at a right angle in directions approaching each other in the coil component according to the second aspect of the present invention.

DESCRIPTION OF THE PREFERRED EMBODIMENTS

Hereinafter, coil components and coil devices according to preferred embodiments of the present invention will be described by referring to the accompanying drawings. The coil components of the preferred embodiments are applied to reactors, for example.

A reactor is used as an electric circuit element of various apparatuses loaded on automobiles, for example, and includes a magnetic core and a reactor coil wound around the core. Normally, a leg part is attached to a reactor main body formed by inserting the reactor core inside the reactor coil so that the reactor main body can be housed in a casing while securing an insulation property between the reactor main body and the case.

Embodiment 1

Figure 1:
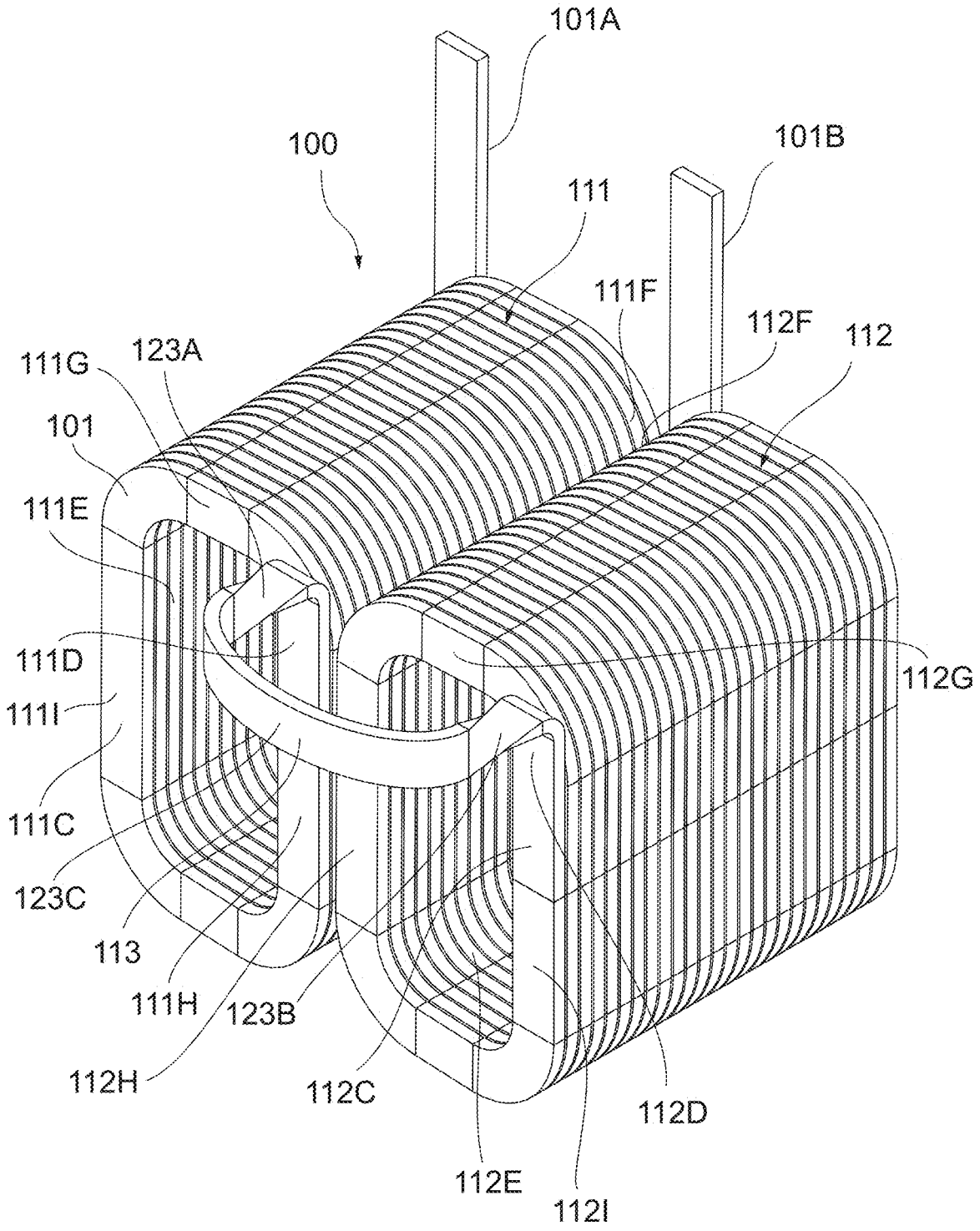
FIG. 1 is a perspective view of a coil component according to a first embodiment of the present invention.
Figure 2:
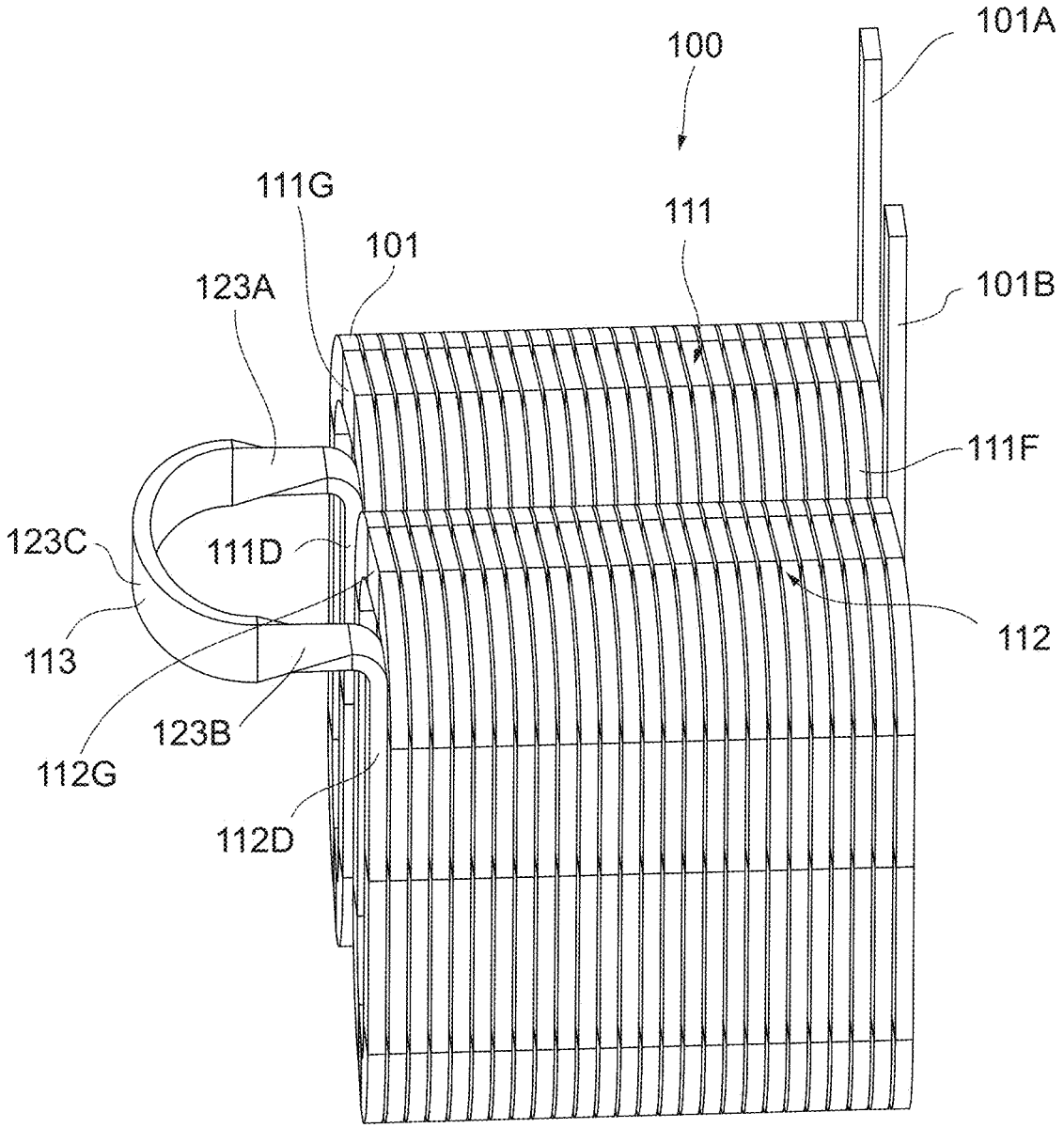
FIG. 2 is a perspective view showing a state of the coil component according to the first embodiment of the present invention illustrated in FIG. 1 viewed from a lateral side.

FIG. 1 is a perspective view of a coil component 100 according to Embodiment 1 viewed from obliquely above, and FIG. 2 is a perspective view showing a state of the coil component according to Embodiment 1 viewed from a lateral side.

As shown in FIG. 1, the coil component 100 of Embodiment 1 is formed by winding and laminating a single flat wire 101 in one direction with edgewise-winding between one end portion 101A and another end portion 101B as connection terminals, and bending the wound and laminated coil into two at a prescribed position (normally at substantially middle position) to provide a first coil element 111 and a second coil element 112 each formed in an angular-tubular shape and disposed in parallel and to provide an interconnection part 113 for connecting the both coil elements 111 and 112.

The flat wire 101 is wound such that there is a margin of the flat wire 101 remained to be used for the interconnection part 113 at the prescribed position of the wound and laminated coil.

The flat wire 101 has a rectangular cross section and formed by applying insulation coating on the surface of a copper wire, for example.

The first coil element 111 and the second coil element 112 are disposed in parallel such that opposing single side-face 111F and single side-face 112F are placed along in parallel to each other with a prescribed space provided therebetween.

The interconnection part 113 includes: a coil element winding end portion side raised part 123A and a coil element winding start portion side raised part 123B configured by twisting and raising the flat wire 101 at a right angle in a same direction with respect to each other in a coil element winding start portion 112D and a coil element winding end portion 111D; and an intermediate part 123C extended between the two raised parts 123A and 123B.

It is to be noted in explanations hereinafter that: among each of sides of a rectangular part forming an end-face of each of the coil elements 111 and 112, the sides of the first coil element 111 and the second coil element 112 opposing to each other and the sides in parallel to those sides are referred to as longitudinal sides (first sides) 111C, 112C; and respective sides of the first coil element 111 and the second coil element 112 adjacent (orthogonal) to those longitudinal sides are referred to as lateral sides (second sides) 111G, 112G. Further, the longitudinal sides 111C, 112C of the first coil element 111 and the second coil element 112 located on inner side are referred to as inner longitudinal sides 111H, 112H, and the longitudinal sides 111C, 112C located on outer side are referred to as outer longitudinal sides 111I, 112I.

As described, in the present embodiment, the interconnection part 113 is pulled out to a front side on the sheet of FIG. 1. Therefore, the flat wire 101 configuring the interconnection part 113 is not interposed between the coil elements 111 and 112, so that it is possible to avoid expansion of the distance between the two coil elements 111 and 112. As a result, the core can be downsized and the deterioration of the magnetic property can be avoided as well.

Further, the flat wire 101 is twisted and raised at 90 degrees (coil element winding end portion side raised part 123A) at the coil element winding end portion 111D of the first coil element 111. At the same time, the flat wire 101 is twisted and raised at 90 degrees in the same direction as the direction of the coil element winding end portion 111D (coil element winding start portion side raised part 123B) at the coil element winding start portion 112D of the second coil element 112. Thereby, twisting angles of the oil element winding end portion side raised part 123A and the coil element winding start portion side raised part 123B are offset, so that the intermediate part 123C comes in an untwisted state. Thereby, the magnetic property is also stabilized.

In the present embodiment, at the above-described interconnection part 113, twisting is employed for forming each of the raised parts 123A and 123B, and extent of bending is kept to necessary minimum amount. Therefore, exfoliation of the insulation coating on the surface of the flat wire 101, which is easily caused by bending work, can be suppressed.

Compared to an interconnection part 213 of Embodiment 2 to be described later, the interconnection part 113 of the present embodiment is in a shape curved toward the front side. Thereby, when manufacturing, it is possible with the coil component of the present embodiment to absorb an error in winding lengths of the coil elements 111 and 112 to some extent.

Further, by having the end-faces of the two coil elements 111 and 112 folded at the position of the interconnection part 113 facing each other, the coil component can be formed through winding the flat wire in the same direction. Therefore, it is possible to reduce the number of man-hours of edgewise-winding and to simplify mechanisms of winding machines.

Figure 3:
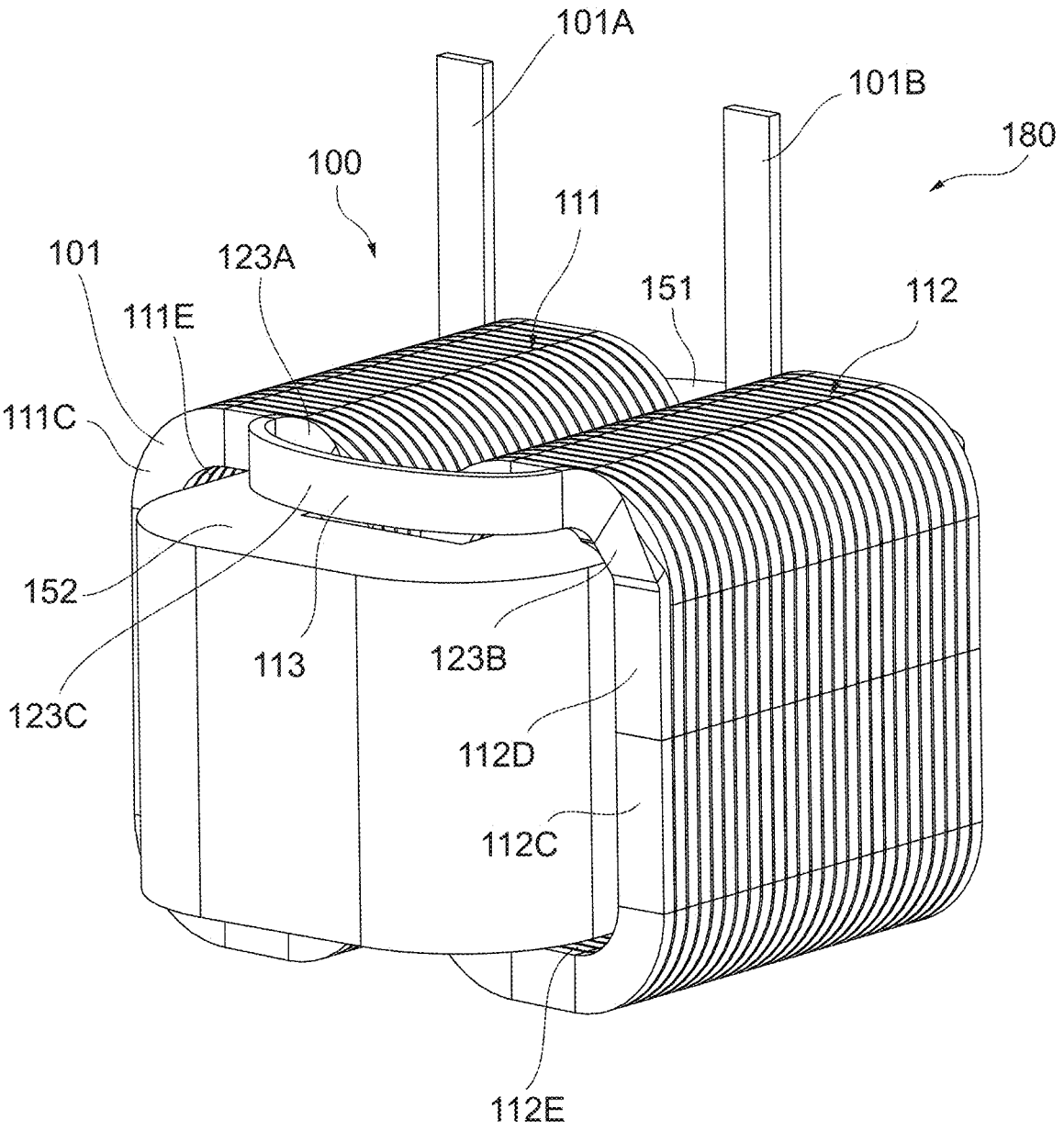
FIG. 3 is perspective view showing a coil device configured by combining the coil component and a core according to the first embodiment of the present invention.
Figure 4:
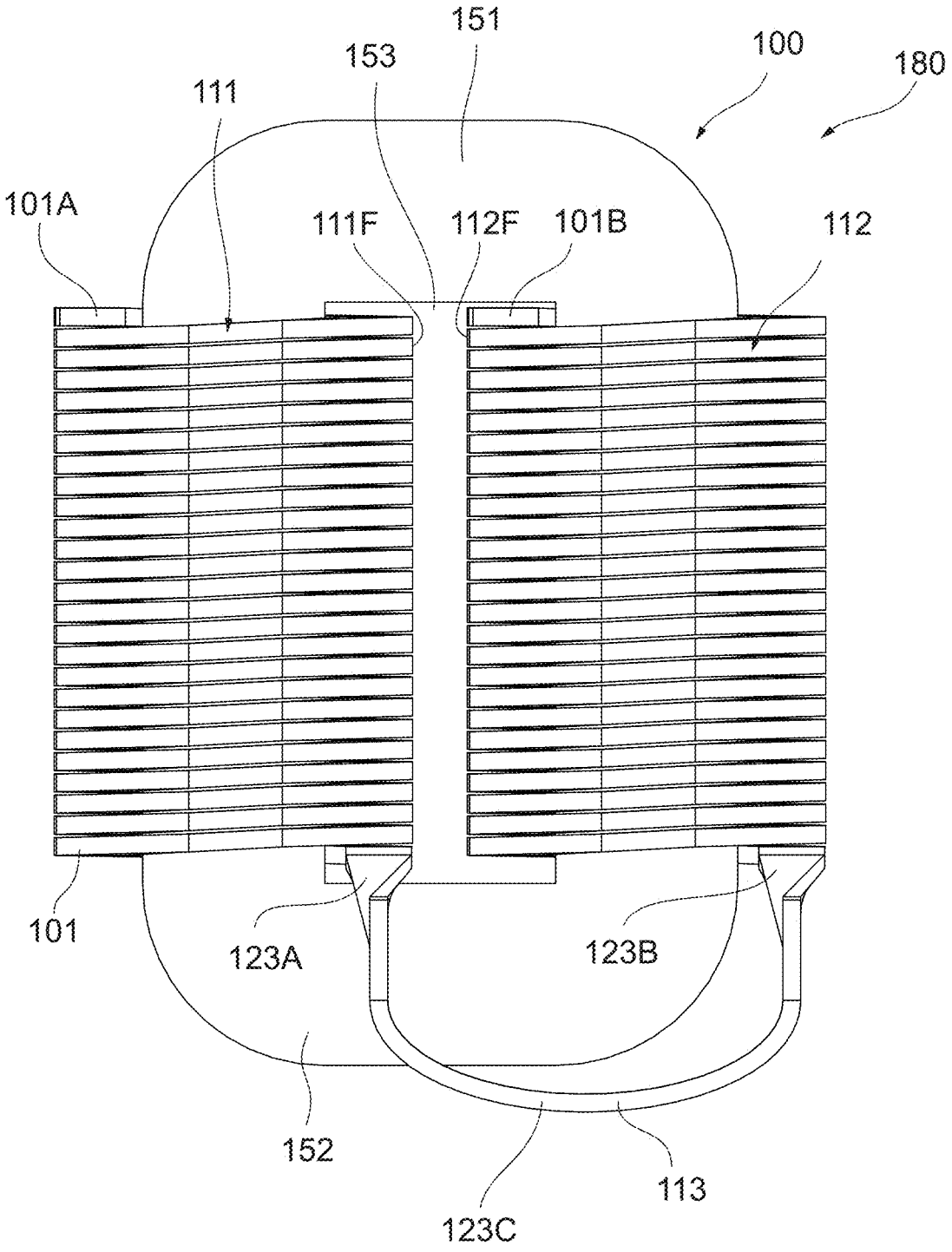
FIG. 4 is a plan view of the coil device shown in FIG. 3 viewed from above.

Regarding the coil component 100 shown in FIG. 1, as shown in FIG. 3 (perspective view) and FIG. 4 (plan view), left and right leg parts of a pair of U-shape cores 151, 152 are inserted into hollow parts 111E, 112E of the two coil elements 111, 112 and abutted against each other inside the hollow parts so as to configure a reactor device (coil device).

FIGS. 5A, 5B and FIGS. 6A, 6B are views showing steps of a manufacturing method of the coil component according to Embodiment 1.

Figure 5A:
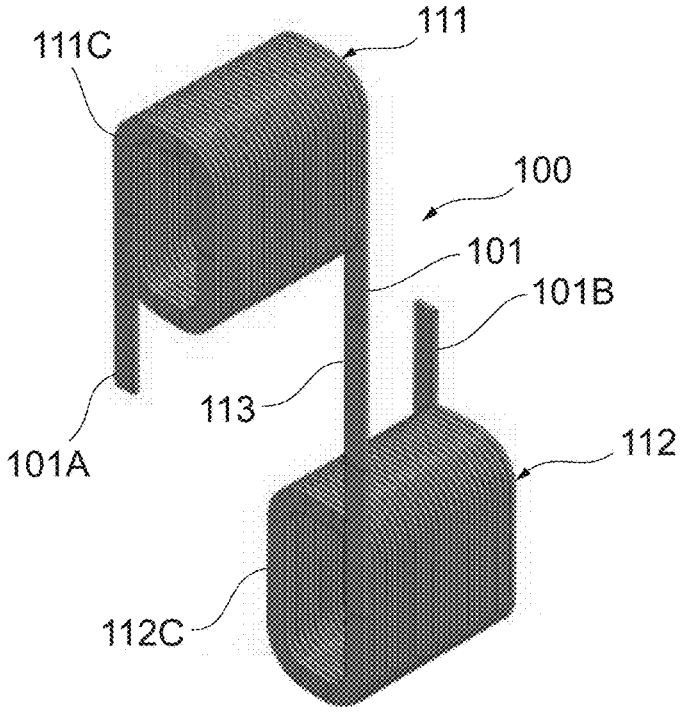
FIG. 5A is a perspective view showing step 1 of a manufacturing method of the coil component according to the first embodiment shown in FIG. 1.

First, as shown in FIG. 5A, the two coil elements 111, 112 are formed by winding one flat wire 101, and a prescribed length of the flat wire 101 for forming the interconnection part 113 is remained in a linear state (manufacturing step 1). The winding directions of the two coils 111 and 112 are the same.

Figure 5B:
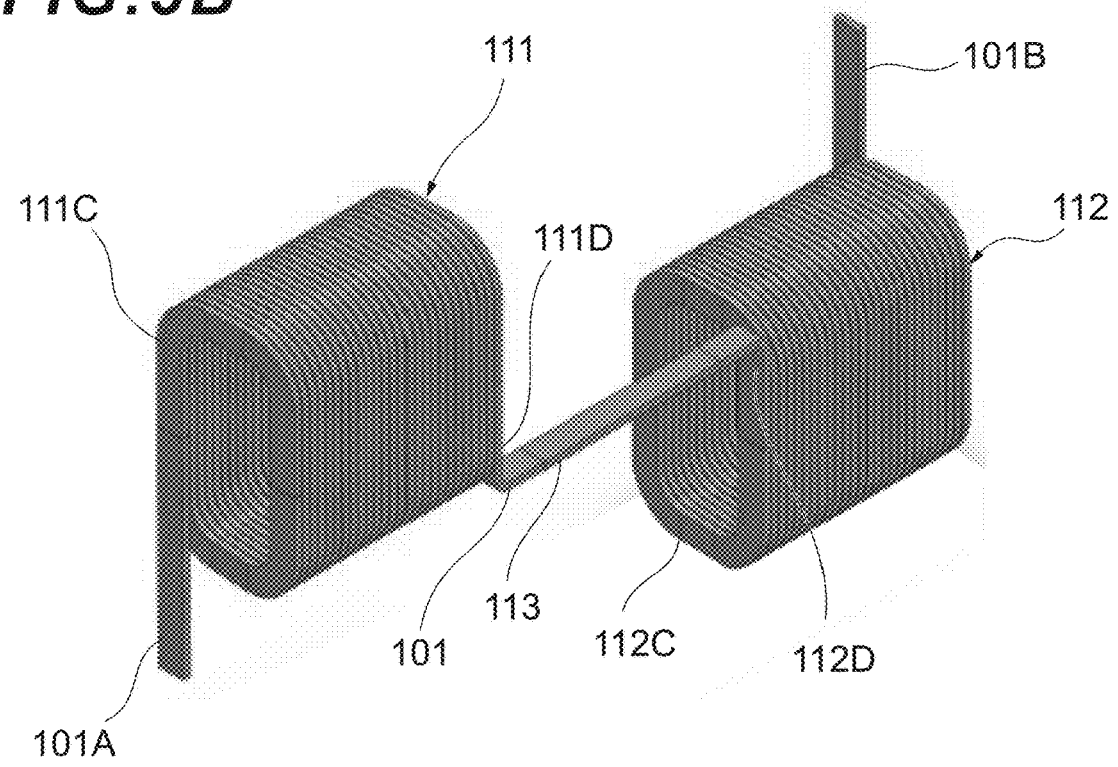
FIG. 5B is a perspective view showing step 2 of the manufacturing method of the coil component according to the first embodiment shown in FIG. 1.

Then, as shown in FIG. 5B, at the coil element winding end portion 111D of the first coil element 111, the flat wire 101 is bent at 90 degrees in a manner of flatwise bending. Further, at the coil element winding start portion 112D of the second coil element 112, the flat wire 101 is bent also in the manner of flatwise bending at 90 degrees in an opposite direction with respect to the bending direction at the coil element winding end portion 111D (manufacturing step 2). Note here that "flatwise bending" is that the flat wire is bent in a direction of the long side by having one face on the long-side side of the rectangular cross section of the flat wire as the inner diameter face and the other face as an outer diameter face.

Figure 6A:
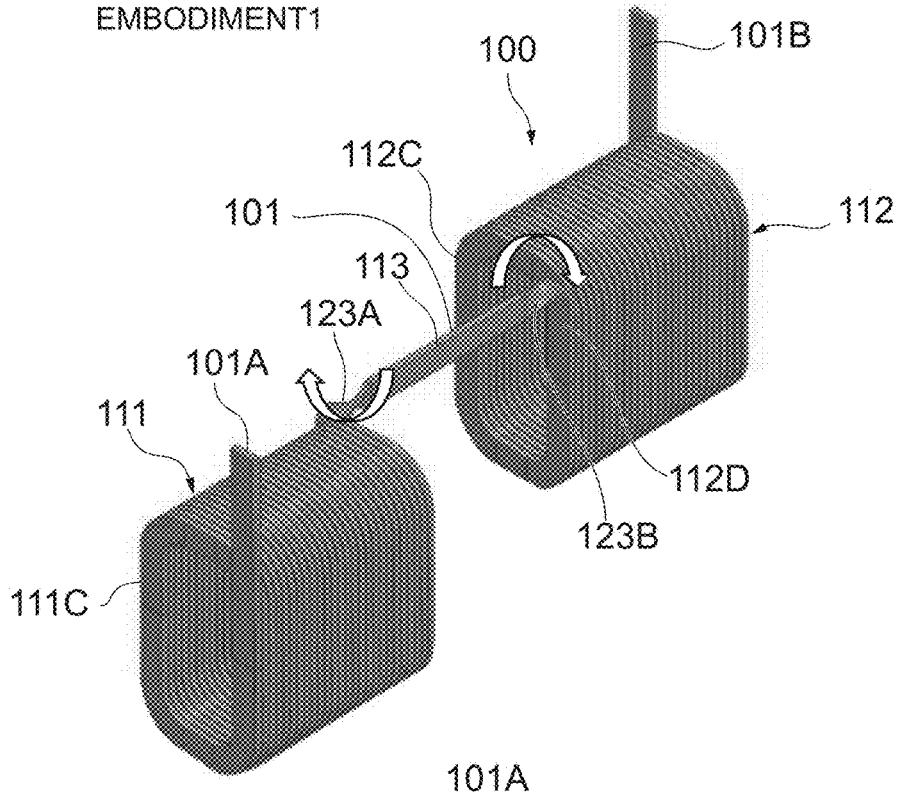
FIG. 6A is a perspective view showing step 3 of the manufacturing method of the coil component according to the first embodiment shown in FIG. 1.

As shown in FIG. 6A, at the bent part of the coil element winding end portion 111D, the flat wire 101 is twisted at 90 degrees with an axis of the flat wire 101 being the center. Further, also at the bent part of the coil element winding start portion 112D of the second coil element 112, the flat wire 101 is twisted at 90 degrees with the axis of the flat wire 101 being the center in the same direction as the twisting direction of the bent part of the coil element winding end portion 111D (manufacturing step 3).

Figure 6B:
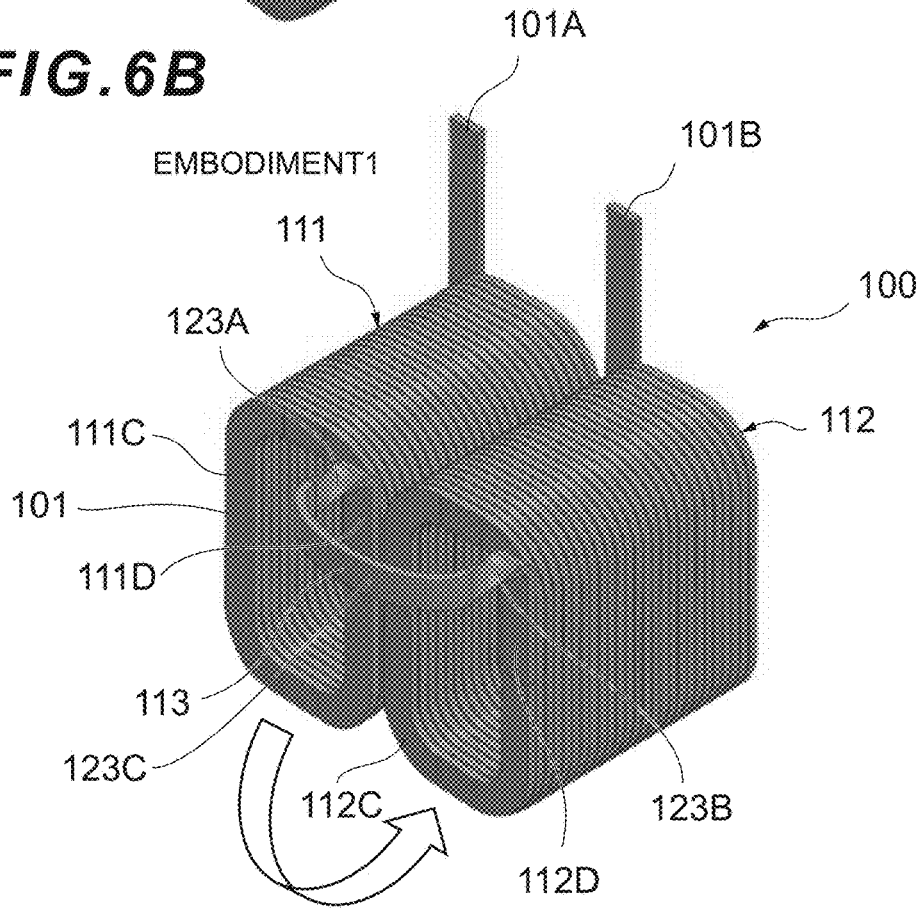
FIG. 6B is a perspective view showing step 4 of the manufacturing method of the coil component according to the first embodiment shown in FIG. 1.

At last, as shown in FIG. 6B, by bending the two coil elements 111, 112 into two at the position of the interconnection part 113 (roughly at the middle position), the first coil element 111 and the second coil element 112 are disposed in parallel and the both coil elements 111, 112 can be in a connected state by the interconnection part 113 (manufacturing step 4).

As described, the twisted angle, 90 degrees, of the coil element winding end portion side raised part 123A and the twisted angle, 90 degrees, of the coil element winding start portion side raised part 123B are offset, so that the intermediate part 123C of the interconnection part 113 comes in an untwisted state.

Embodiment 2

In this Embodiment 2, there are many members common (corresponding) to the members of Embodiment 1 described above. Therefore, reference numerals acquired by adding 100 to the reference numerals of the members of Embodiment 1 are applied to such common (corresponding) members, and detailed explanations of such members are to be omitted.

Figure 7:
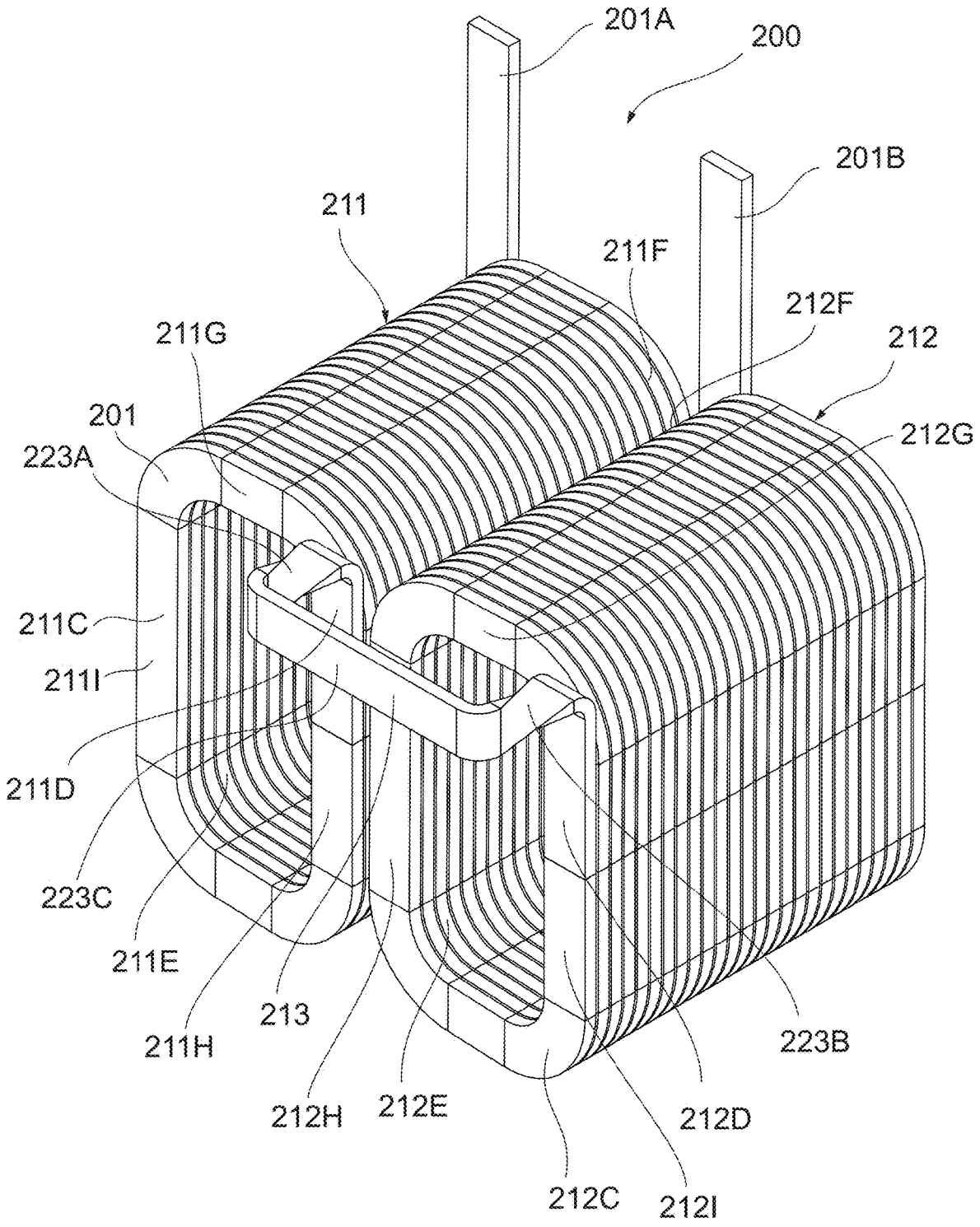
FIG. 7 is a perspective view of a coil component according to a second embodiment of the present invention.

That is, as shown in FIG. 7, a coil component 200 of the present embodiment is similar to the coil component 100 of Embodiment 1 described above in respect that the coil component 200 is configured by winding and laminating a single flat wire 201 with edgewise-winding between one end portion 201A and another end portion 201B as connection terminals, and bending the wound and laminated coil into two at a prescribed position (normally at substantially middle position) to provide a first coil element 211 and a second coil element 212 each formed in an angular-tubular shape and disposed in parallel and to provide an interconnection part 213 for connecting the both coil elements 211 and 212.

Further, while working effects of the interconnection part 213 are also similar, the interconnection part 213 has its intermediate part 223C configured substantially in a flat-plate shape but not in a curved shape like the intermediate part 123C of the interconnection part 113 of Embodiment 1. With the coil component 200 of Embodiment 2, it is easy to precisely define length of the intermediate part 223C so that precision of the magnetic property can be improved.

Figure 8:
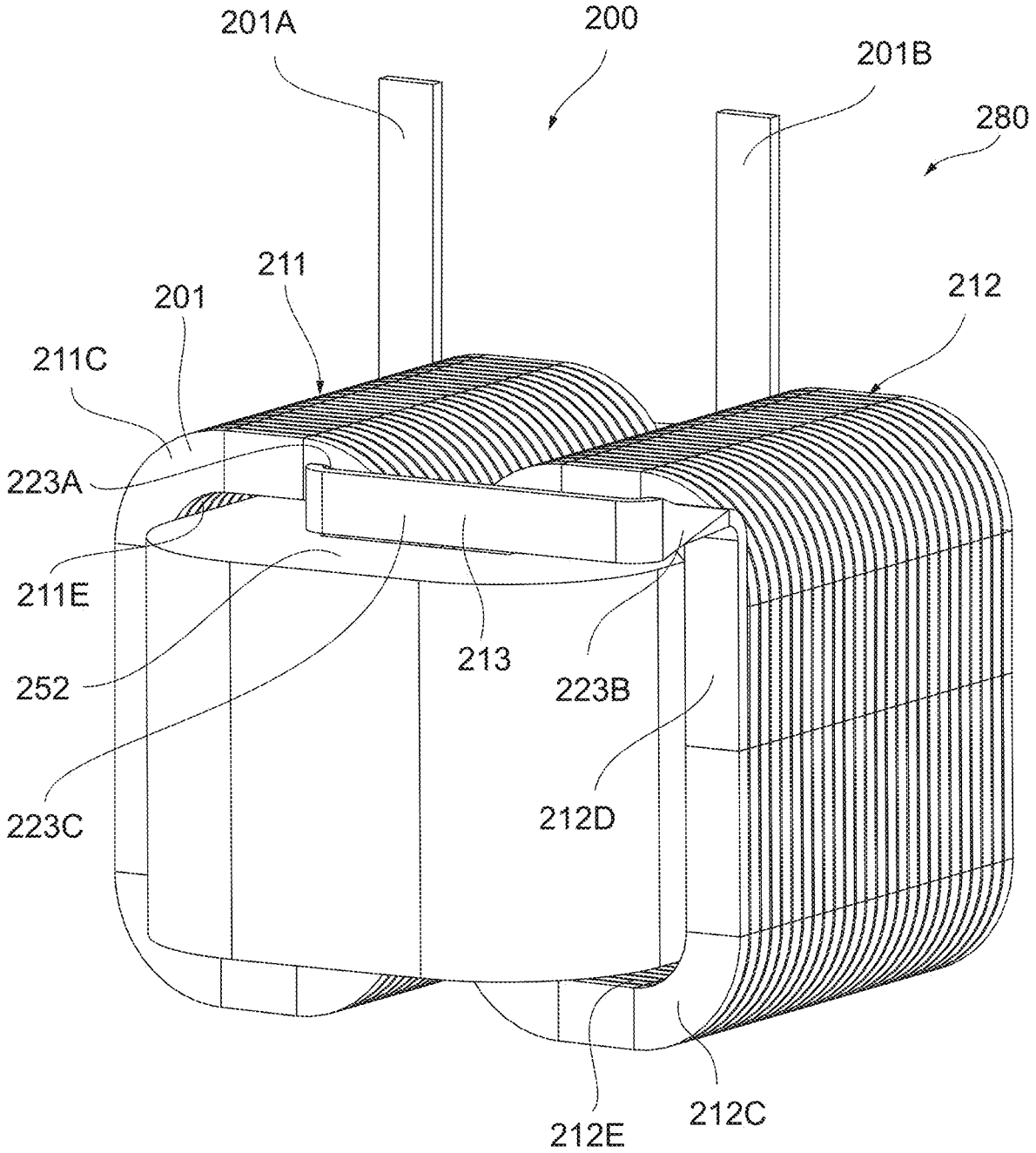
FIG. 8 is a perspective view showing a coil device configured by combining the coil component and a core according to the second embodiment of the present invention.

Further, as shown in FIG. 8, the coil component 200 of Embodiment 2 is also similar to the coil component 100 of Embodiment 1 described above in respect that left and right leg parts of a pair of U-shape cores 251 (not shown), 252 are inserted into hollow parts 211E, 212E of the two coil elements 211, 212 and abutted against each other inside the hollow parts 211E, 212E so as to configure a reactor device (coil device).

Further, FIGS. 9A, 9B and FIGS. 10A, 10B are views showing steps of a manufacturing method of the coil component according to Embodiment 2. This manufacturing method of the coil component is also similar to the manufacturing method of the coil component according to Embodiment 1.

Figure 9A:
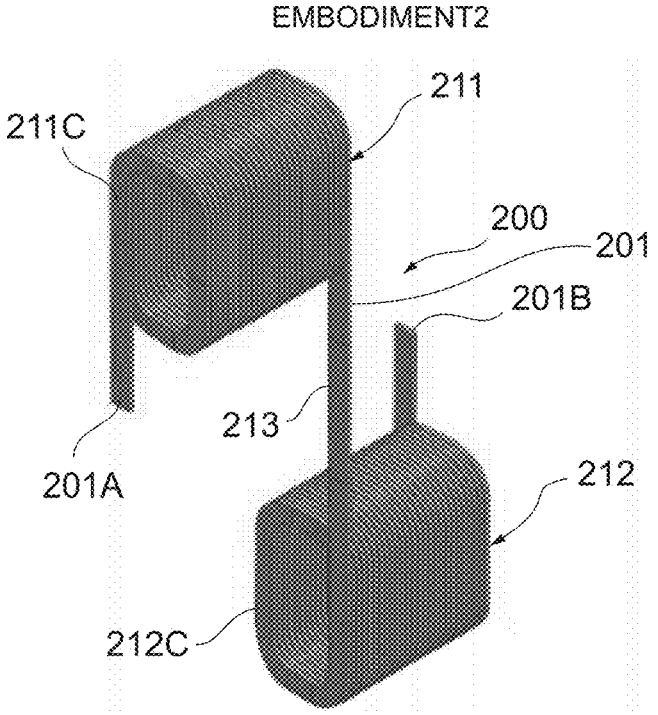
FIG. 9A is a perspective view showing step 1 of a manufacturing method of the coil component according to the second embodiment shown in FIG. 7.
Figure 9B:
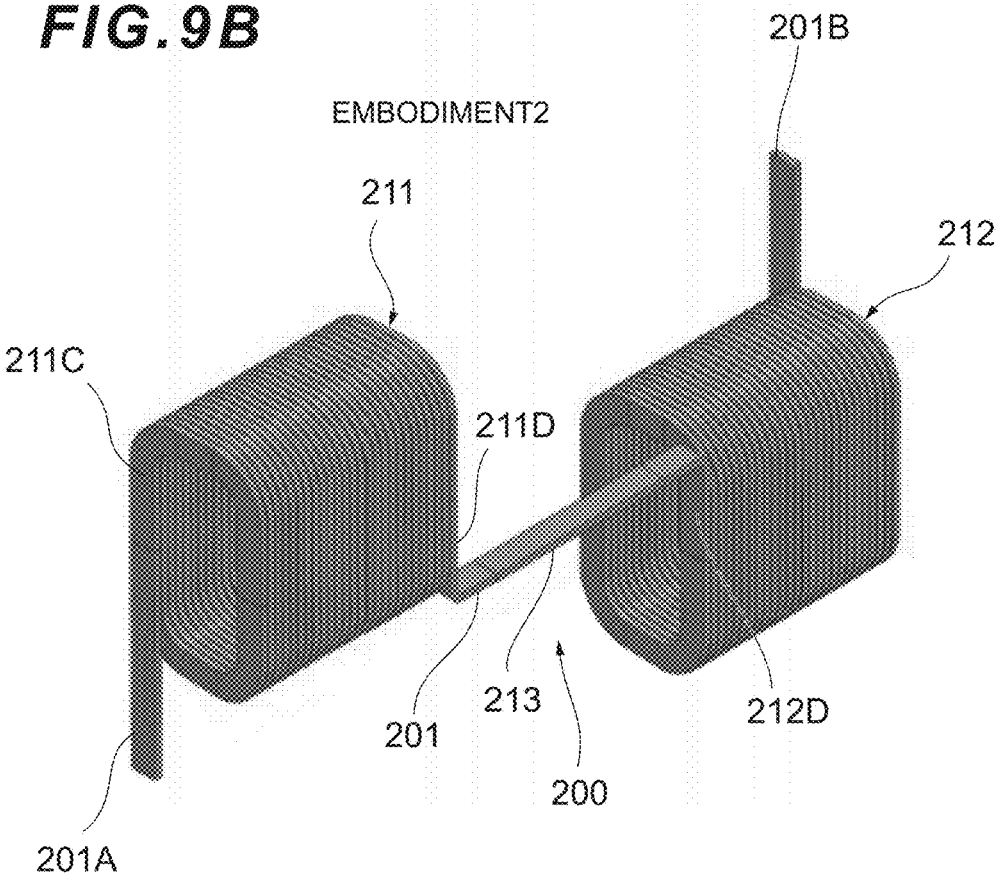
FIG. 9B is a perspective view showing step 2 of the manufacturing method of the coil component according to the second embodiment shown in FIG. 7.
Figure 10A:
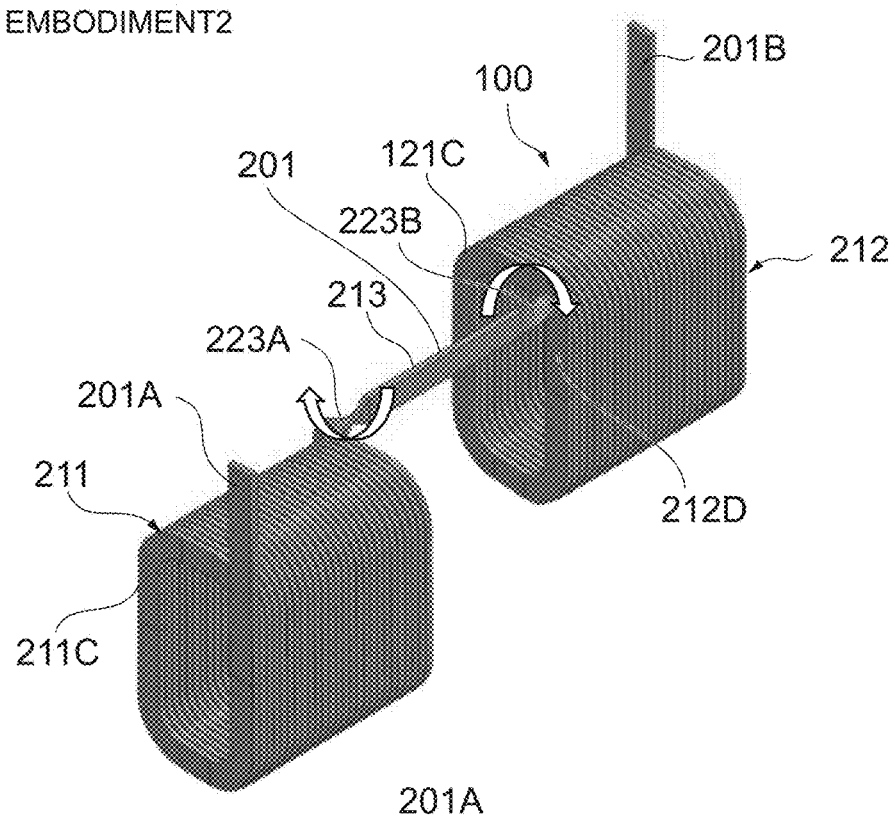
FIG. 10A is a perspective view showing step 3 of the manufacturing method of the coil component according to the second embodiment shown in FIG. 7.
Figure 10B:
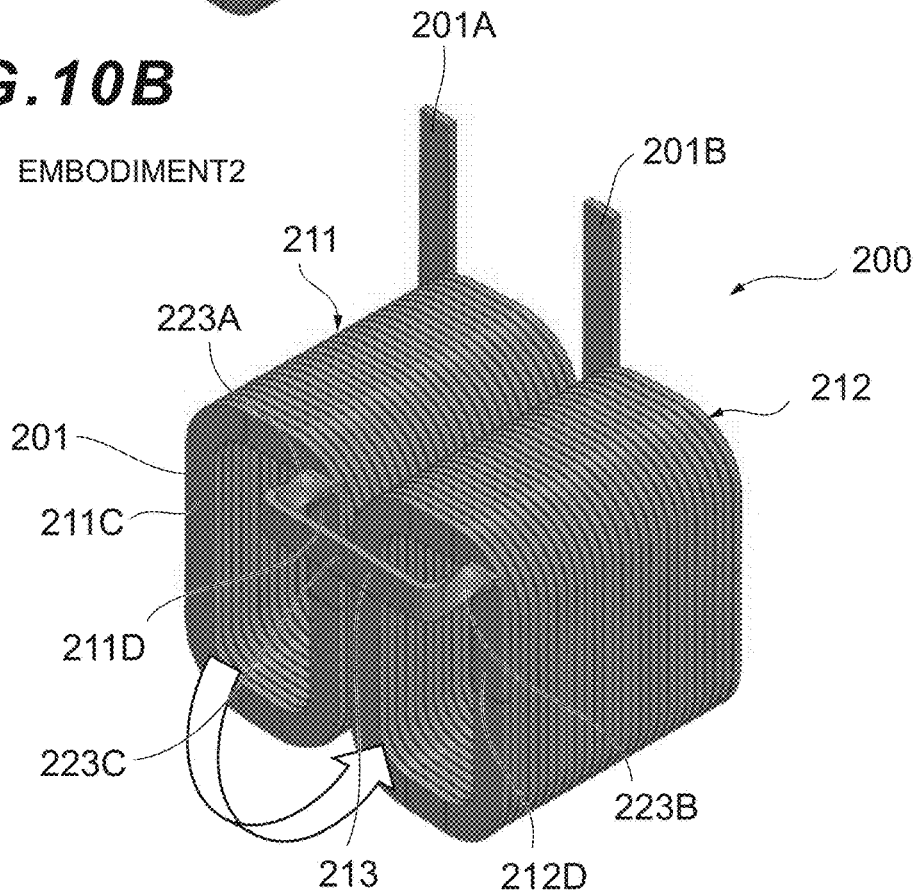
FIG. 10B is a perspective view showing step 4 of the manufacturing method of the coil component according to the second embodiment shown in FIG. 7.

That is, FIG. 9A shows manufacturing step 1 similar to that shown in FIG. 5A, FIG. 9B shows manufacturing step 2 similar to that shown in FIG. 5B, FIG. 10A shows manufacturing step 3 similar to that shown in FIG. 6A, and FIG. 10B shows manufacturing step 4 similar to that shown in FIG. 6B.

In the manufacturing method of the coil component according to Embodiment 2, the twisted angle, 90 degrees, of a coil element winding end portion side raised part 223A and the twisted angle, 90 degrees, of a coil element winding start portion side raised part 223B are also offset, so that the intermediate part 223C of the interconnection part 213 comes in an untwisted state.

Embodiment 3

In this Embodiment 3, there are many members common (corresponding) to the members of Embodiment 1 described above. Therefore, reference numerals acquired by adding 200 to the reference numerals of the members of Embodiment 1 are applied to such common (corresponding) members, and detailed explanations of such members are to be omitted.

Figure 11:
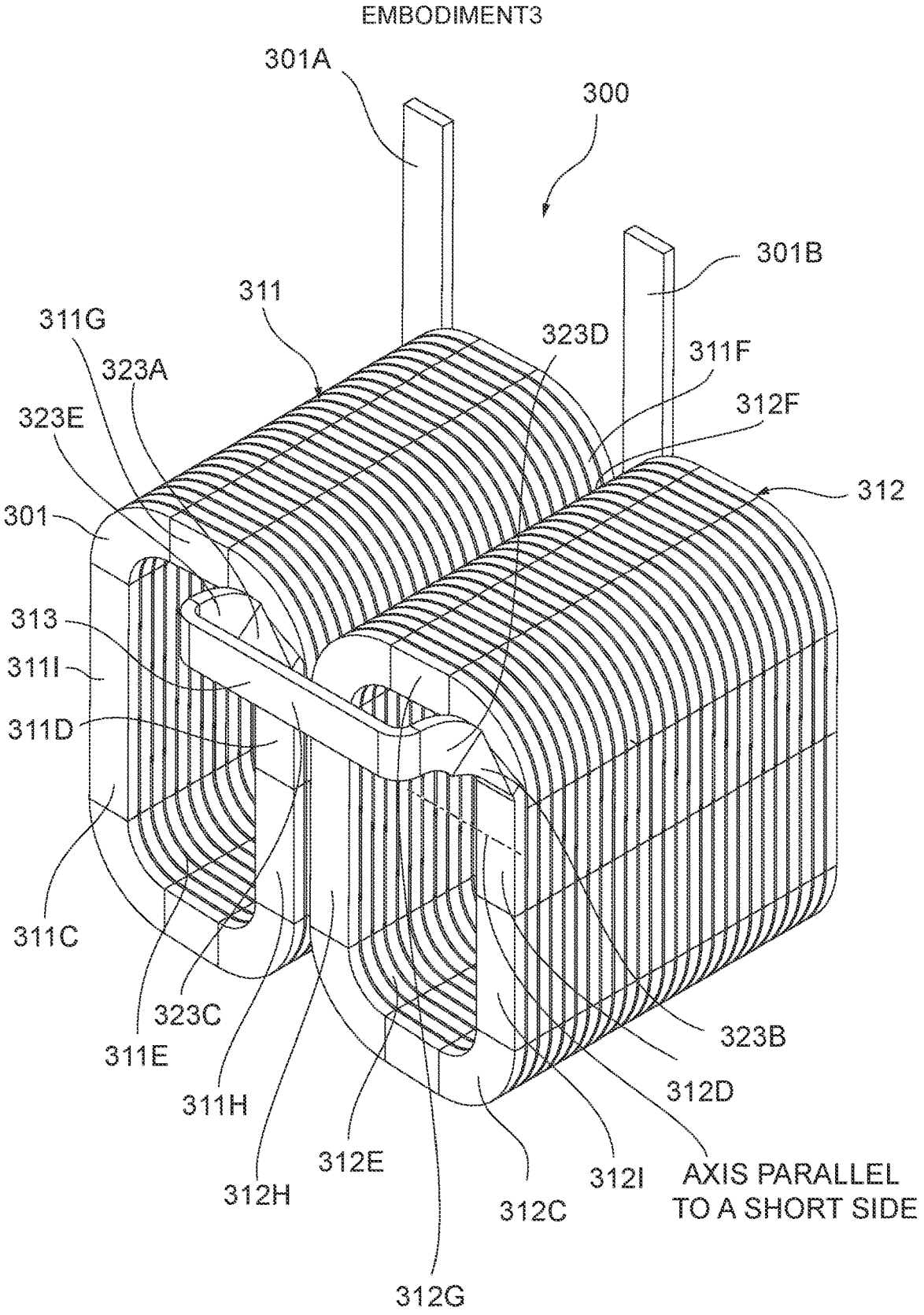
FIG. 11 is a perspective view of a coil component according to a third embodiment of the present invention.
Figure 12:
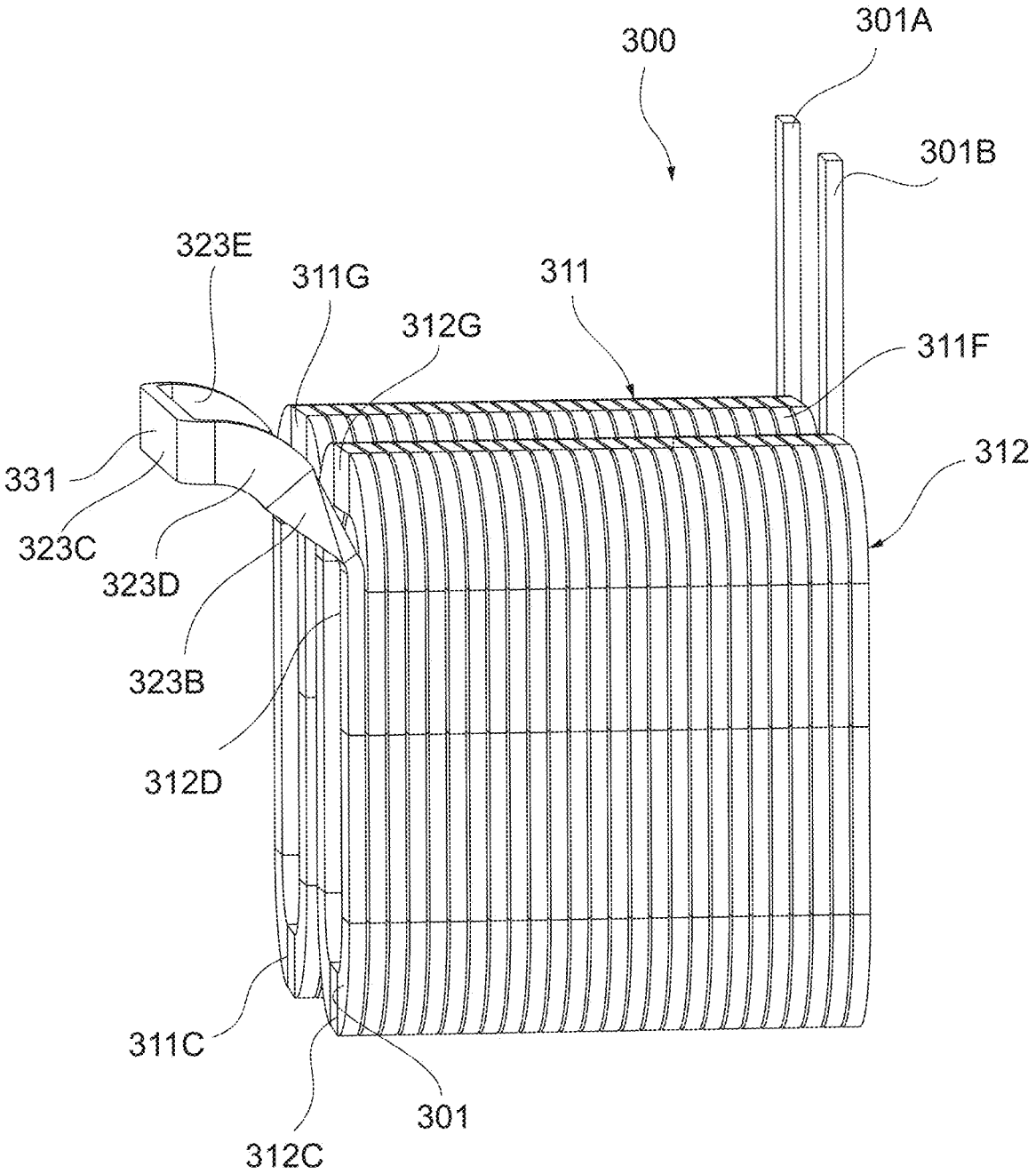
FIG. 12 is a perspective view showing a state of the coil component according to the third embodiment of the present invention viewed from a lateral side.

That is, as shown in FIG. 11 (perspective view) and FIG. 12 (perspective view showing a state viewed from lateral side), a coil component 300 of the present embodiment is similar to the coil component 100 of Embodiment 1 described above in respect that the coil component 300 is configured by winding and laminating a single flat wire 301 with edgewise-winding between one end portion 301A and another end portion 301B as connection terminals, and bending the wound and laminated coil into two at a prescribed position (normally at substantially middle position) to provide a first coil element 311 and a second coil element 312 each formed in an angular-tubular shape and disposed in parallel and to provide an interconnection part 313 for connecting the both coil elements 311 and 312.

Further, while working effects of the interconnection part 313 are also similar, shapes of a coil element winding end portion side raised part 323A and a coil element winding start portion side raised part 323B of the interconnection part 313 are slightly different. That is, in the coil element winding end portion side raised part 323A, the flat wire 301 is twisted and raised and then formed into r-shape in the manner of edgewise-winding to provide an r-part 323E. Also, in the coil element winding start portion side raised part 323B, the flat wire 301 is twisted and raised and then formed into r-shape in the manner of edgewise-winding to provide an r-part 323D. Thereby, the interconnection part 313 as a whole is brought upward on the sheet of FIG. 11. That is, as shown in FIG. 12, the intermediate part 323C is provided to be positioned on an upper side than top faces of the first coil element 311 and the second coil element 312.

Further, while the intermediate part 323C of the interconnection part 313 is formed in a tabular shape as in the case of Embodiment 2 described above, the intermediate part 323C may be formed in a curved shape as in the case of Embodiment 1 described above.

Figure 13:
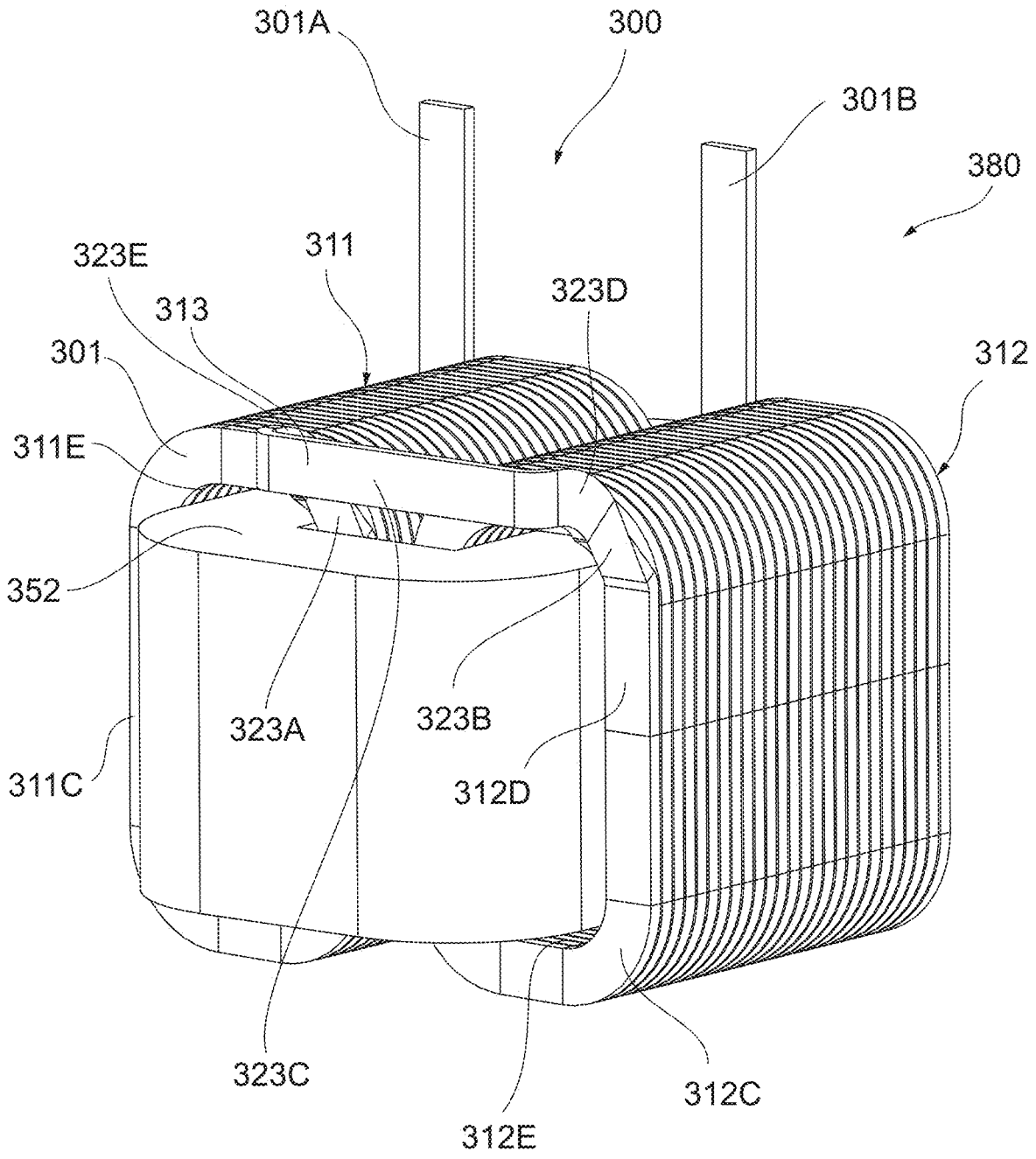
FIG. 13 is perspective view showing a coil device configured by combining the coil component and a core according to the third embodiment of the present invention.

Further, as shown in FIG. 13, the coil component 300 of Embodiment 3 is also similar to the coil component 100 of Embodiment 1 described above in respect that left and right leg parts of a pair of U-shape cores 351 (not shown), 352 are inserted into hollow parts 311E, 312E of the two coil elements 311, 312 and abutted against each other inside the hollow parts 311E, 312E so as to configure a reactor device (coil device). In the present embodiment, however, the intermediate part 323C of the interconnection part 313 is provided to be located still upper side in the drawing. Therefore, in the manufacturing steps, the left and right leg parts of the U-shaped cores 351, 352 can be inserted into the hollow parts 311E, 312E easily.

Further, FIGS. 14A, 14B and FIGS. 15A, 15B are views showing steps of a manufacturing method of the coil component according to Embodiment 3. Basically, this manufacturing method of the coil component is also similar to the manufacturing method of the coil component according to Embodiment 1.

Figure 14A:
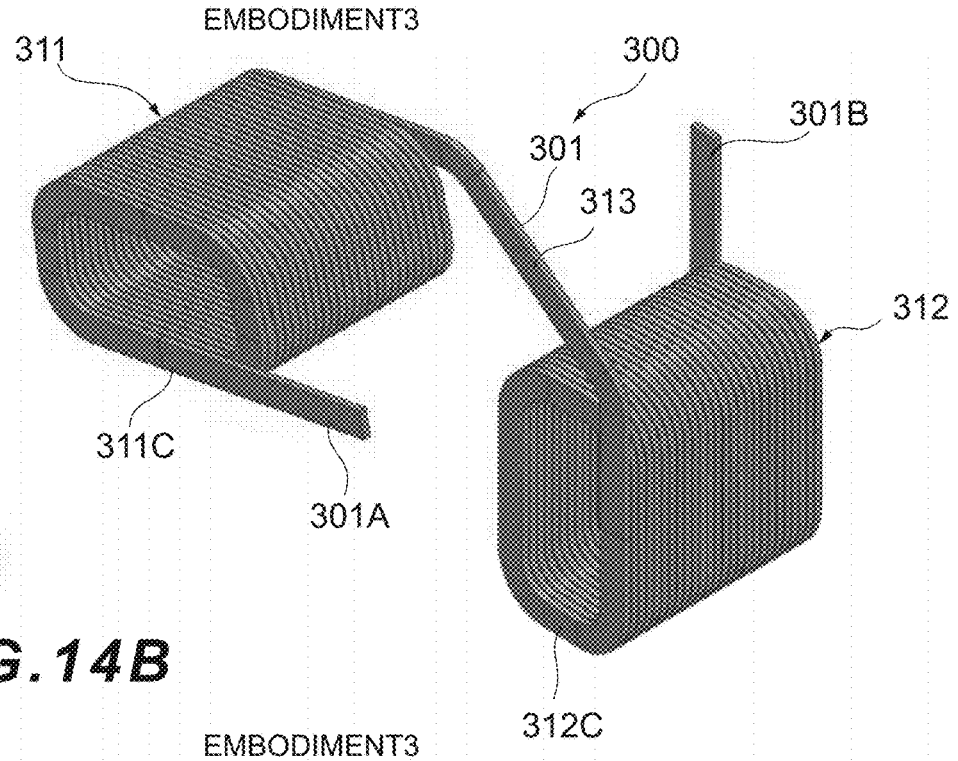
FIG. 14A is a perspective view showing step 1 of a manufacturing method of the coil component according to the third embodiment shown in FIG. 11.
Figure 14B:
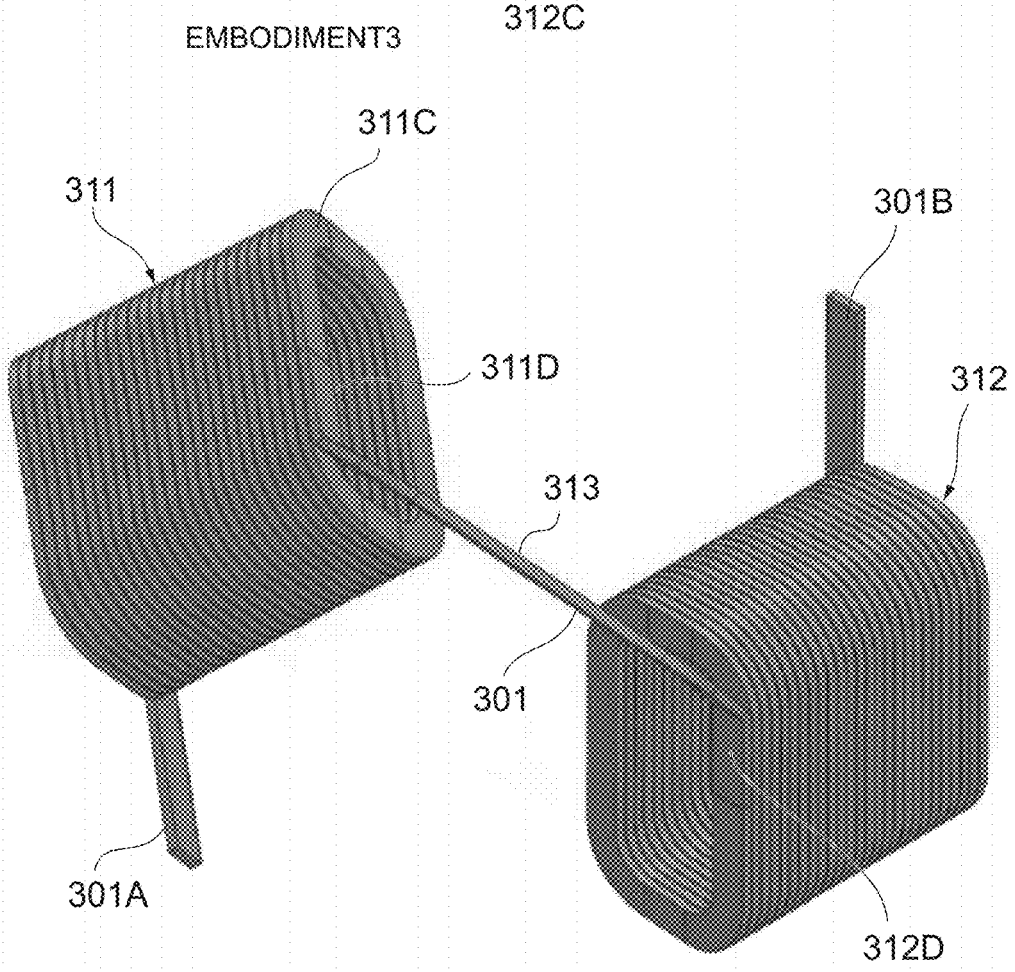
FIG. 14B is a perspective view showing step 2 of the manufacturing method of the coil component according to the third embodiment shown in FIG. 11.
Figure 15A:
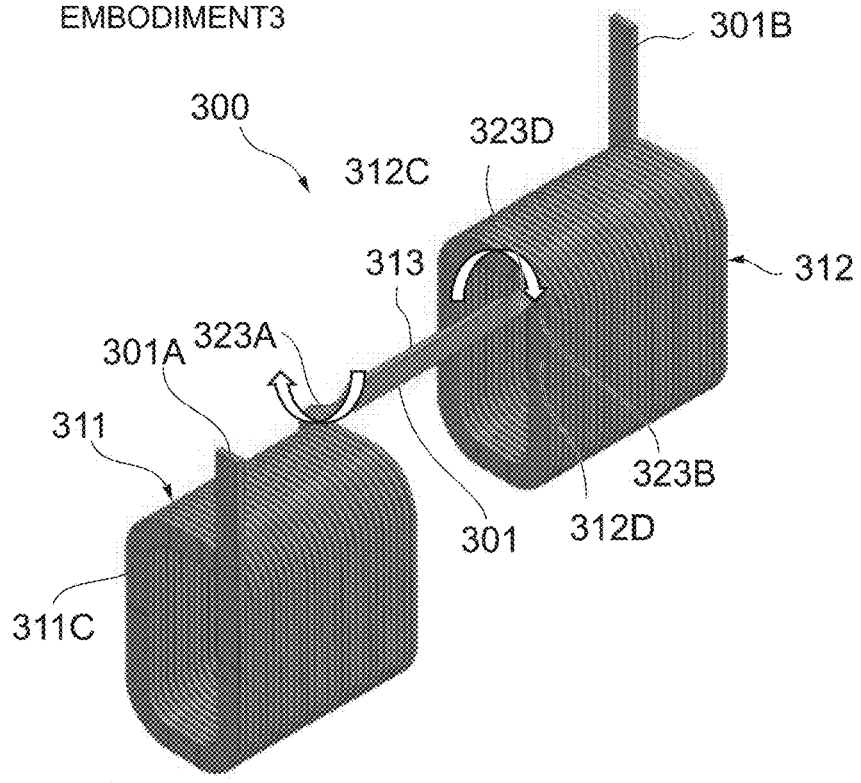
FIG. 15A is a perspective view showing step 3 of the manufacturing method of the coil component according to the third embodiment shown in FIG. 11.
Figure 15B:
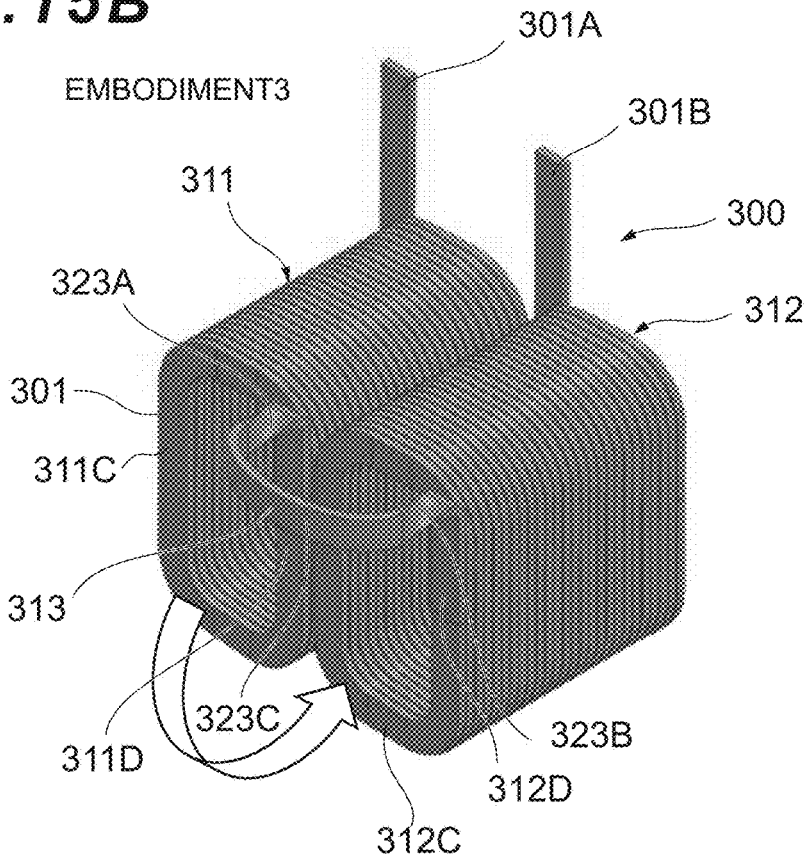
FIG. 15B is a perspective view showing step 4 of the manufacturing method of the coil component according to the third embodiment shown in FIG. 11.

That is, FIG. 14A shows manufacturing step 1 similar to that shown in FIG. 5A, FIG. 14B shows manufacturing step 2 similar to that shown in FIG. 5B, FIG. 15A shows manufacturing step 3 similar to that shown in FIG. 6A, and FIG. 15B shows manufacturing step 4 similar to that shown in FIG. 6B.

In the present embodiment, however, the coil element winding end portion side raised part 323A includes the r-part 323E, and the coil element winding start portion side raised part 323B includes the r-part 323D. Therefore, as shown in FIG. 14A, in manufacturing step 1 for forming the r-parts 323D and 323E, unlike manufacturing step 1 of Embodiment 1, the first coil element 311 is rotated by 90 degrees with respect to the second coil element 312, and the r-parts 323D and 323E bent by 45 degrees by edgewise-winding are formed between the first coil element 311 and the interconnection part 313 and between the second coil element 312 and the interconnection part 313.

Further, in manufacturing step 2, the bent part between the first coil element 311 and the interconnection part 313 and the bent part between the second coil element 312 and the interconnection part 313 are bent by 45 degrees in the manner of flatwise bending. In this case, the direction of bending between the first coil element 311 and the interconnection part 313 and the direction of bending between the second coil element 312 and the interconnection part 313 are also opposite with respect to each other.

Manufacturing step 3 and manufacturing step 4 are similar to those of Embodiment 1.

In the manufacturing method of the coil component according to Embodiment 3, the twisted angle, 90 degrees, of the coil element winding end portion side raised part 323A and the twisted angle, 90 degrees, of the coil element winding start portion side raised part 323B are also offset, so that the intermediate part 323C of the interconnection part 313 comes in an untwisted state.

Note that the coil component and the coil device of the present invention are not limited to those of the above-described embodiments but various kinds of other modes can be employed.

Figure 16:
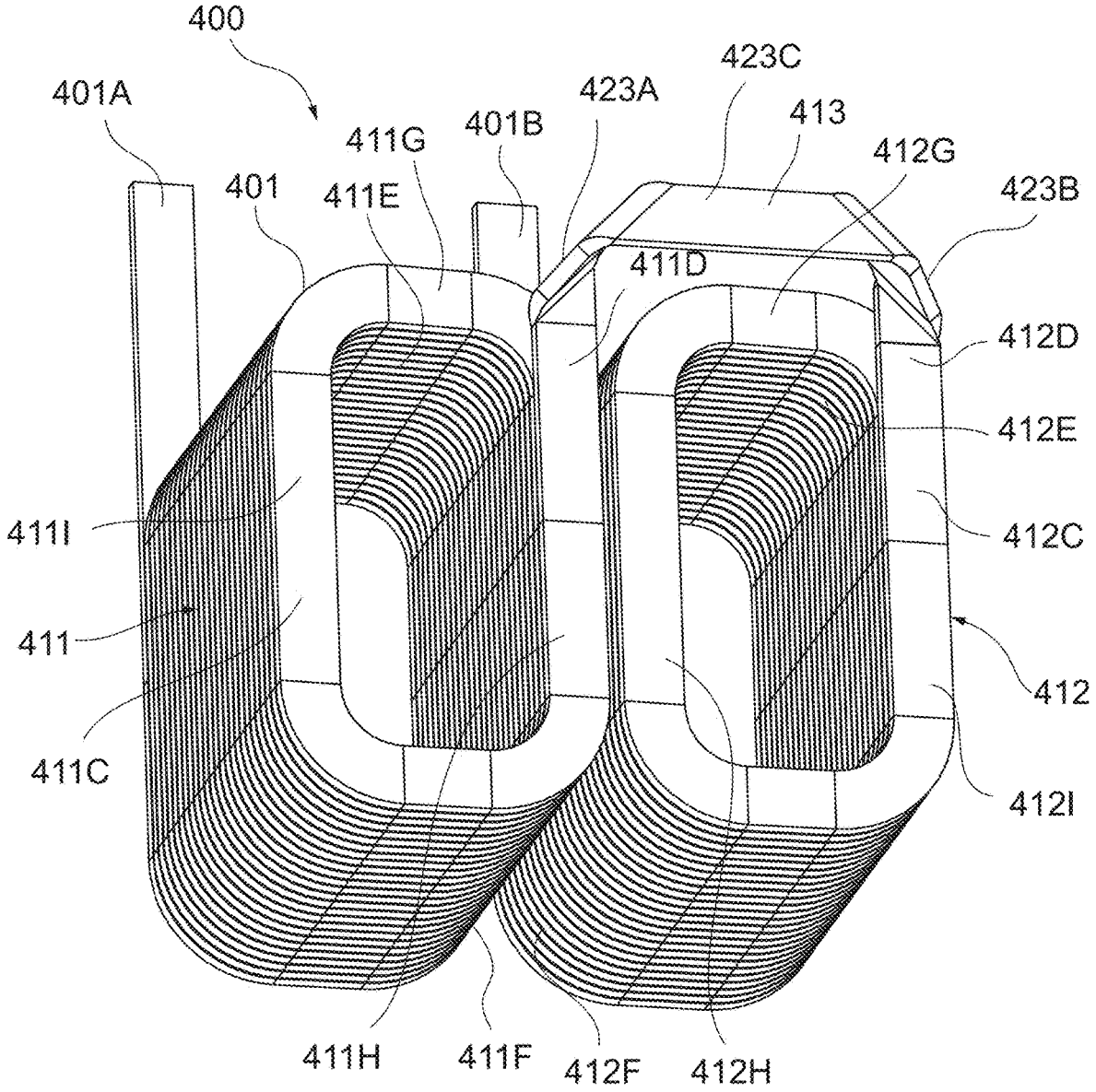
FIG. 16 is a perspective view of a coil component according to a modification of the present invention.
Figure 17:
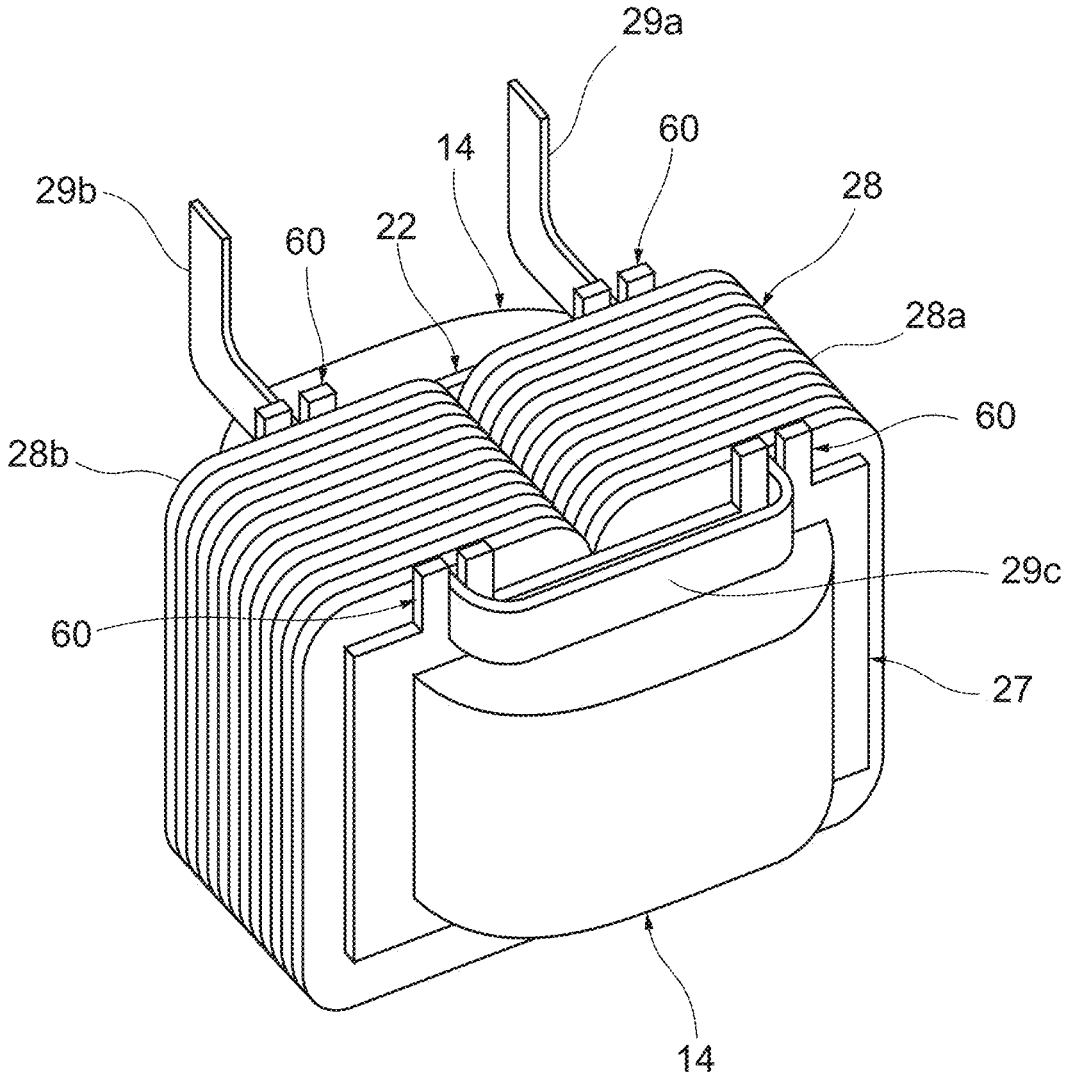
FIG. 17 PRIOR ART
FIG. 17 is a perspective view showing a coil device according to a conventional technique.

Like a coil component 400 of a modification shown in FIG. 16, the interconnection part may be bent to be raised instead of twisting. In the modification shown in FIG. 16, there are many members common (corresponding) to the members of Embodiments 1-3 described above. Therefore, reference numerals acquired by adding 300 to the reference numerals of the members of Embodiment 1 are applied to such common (corresponding) members, and detailed explanations of such members are to be omitted.

That is, the interconnection part of the above-described embodiment (Embodiment 1) includes: the coil element winding end portion side raised part 123A and the coil element winding start portion side raised part 123B configured by twisting and raising the flat wire 101 at a right angle in the same direction with respect to each other in the coil element winding start portion 112D and the coil element winding end portion 111D, and includes the intermediate part 123C extended between the two raised parts 123A, 123B. However, the coil component 400 according to the modification shown in FIG. 16 may include a coil element winding end portion side bent part 423A and a coil element winding start portion side bent part 423B configured by bending a flat wire 401 at a right angle in directions approaching each other in a coil element winding start portion 411D and a coil element winding end portion 412D, and may include an intermediate part 423C similar to that of the above-described embodiment extended between the two bent parts 423A, 423B.

Further, it is to be noted that the manufacturing method of the coil component is not limited to the manufacturing methods of the coil component depicted in the above-described embodiments but various kinds of manufacturing methods can be employed.

Further, in the embodiment described above, connecting points of the interconnection part 113 are provided in the vicinity of the edges of the longitudinal sides. However, the flat wire may be extended from the edges of the longitudinal sides and the connecting points may be set on the extended wire. Note that it is not preferable to set the connecting points in the midway of the longitudinal sides since the interconnection part interferes with the core.

Furthermore, while shown in the embodiments described above are the reactors (coil components) applied to the reactors used for automobiles, the coil component and the coil device according to the present invention are not limited to be used for automobiles but may be applicable to various kinds of application. For example, the coil component and the coil device of the present invention can be applied to reactors used for solar power panels.

What is claimed is:

1. A coil component comprising:

a first coil element and a second coil element formed by dividing and folding into two, at a prescribed position, a winding coil formed by laminating a single flat wire into a rectangular shape with edgewise-winding, the first coil element and the second coil element being disposed with opposing side-faces parallel to each other; and an interconnection part that connects the first coil element and the second coil element, wherein in end-faces where the first coil element and the second coil element are connected, a side of the first coil element and a side of the second coil element adjacent to each other among sides of a rectangular part forming the end-faces of the first coil element and the second coil element and sides parallel to the side of the first coil element and the side of the second coil element adjacent to each other are first sides, the interconnection part connects a coil element winding end portion in vicinity of an edge of one of the first sides of one of the first coil element and the second coil element or on an extension of the first side with a coil element winding start portion in vicinity of an edge of one of the first sides of the other one of the first coil element and the second coil element or on an extension of the first side;

the single flat wire includes a longitudinal direction and a rectangular cross-section perpendicular to the longitudinal directional, the rectangular cross-section including a short side and a long side, and the interconnection part includes, in each of the coil element winding start portion and the coil element winding end portion:

a twist of the single flat wire about the longitudinal direction and a bend around an axis parallel to the short side so that both the coil element winding start portion and the coil element winding end portion are raised at a right angle in a same direction with respect to the end faces, and an intermediate part extended between the coil element winding start portion and the coil element winding end portion side.

2. The coil component according to claim 1, wherein the first sides on inner side of the first coil element and the second coil element are inner first sides and the first sides located on outer side are outer first sides, the interconnection part connects either one of the coil element winding start portion and the coil element winding end portion in vicinity of an edge of one of the inner first sides of one of the first coil element and the second coil element or on an extension of the inner first side with another one out of the coil element winding start portion and the coil element winding end portion in vicinity of an edge of one of the outer first sides of the other one out of the first coil element and the second coil element or on an extension of the outer first side.

3. The coil component according to claim 1, wherein the intermediate part is a curved shape.

4. The coil component according to claim 1, wherein the intermediate part is a planar shape.

5. A coil device comprising:

the coil component according to claim 1; and a magnetic core forming a closed magnetic path by inserting each leg part into a hollow part of the coil component.

6. The coil component according to claim 1, wherein the rectangular shape with edgewise-winding includes a rounded corner and a straight side, and the twist is at an end of the straight side and before the rounded corner.

7. The coil component according to claim 1, wherein the bend is further along the single flat wire from a respective one of the end faces than the twist.

* * * * *